United States Patent [19]

Saunders

[11] 4,118,939

[45] Oct. 10, 1978

[54] MINE ROOF SUPPORT

[75] Inventor: Graham John Saunders, Newcastle Upon Tyne, England

[73] Assignee: Huwood Limited, Gateshead on Tyne, England

[21] Appl. No.: 829,200

[22] Filed: Aug. 30, 1977

[30] Foreign Application Priority Data

Sep. 3, 1976 [GB] United Kingdom ..... 36517/76

[51] Int. Cl.[2] ..... E21D 15/44

[52] U.S. Cl. ..... 61/45 D

[58] Field of Search ..... 61/45 D; 299/31–33; 91/170 MP; 248/357

[56] References Cited

U.S. PATENT DOCUMENTS

| | | | |
|---|---|---|---|
| 3,218,811 | 11/1965 | Barall et al. | 61/45 D |
| 3,324,664 | 6/1967 | Allen | 61/45 D |

FOREIGN PATENT DOCUMENTS

| | | | |
|---|---|---|---|
| 1,262,991 | 2/1972 | United Kingdom | 61/45 D |

*Primary Examiner*—Dennis L. Taylor

*Attorney, Agent, or Firm*—Kemon & Estabrook

[57] ABSTRACT

This invention provides a mine roof support in which the cover, or canopy, is connected to a framework in such a way that the canopy can tilt relatively to the framework both in the fore-and-aft sense of the support and from side to side of the support. Thus, even though the framework can not tilt relatively to the base, the cover can nevertheless tilt to take up irregularities in the lie of the roof.

7 Claims, 7 Drawing Figures

MINE ROOF SUPPORT

This invention concerns mine roof supports. Such supports are known in which there is a cover and a base, and means mounted on the base by which the separation between the cover and the base can be varied. When the support is in use, the separation can be established to be such that the cover is in supporting engagement with the roof of the mine; to enable the support to be moved longitudinally of the mine, the separation is reduced.

Now there have also been proposals for providing a framework that effects a linkage between the rear end of the cover and the rear end of the base that can open and close as the cover moves relatively to the base. The linkage may be a so-called "lemniscate" linkage which is such as to constrain the connection between the cover and the linkage to move more-or-less in a plane that is perpendicular to the base. This facilitates the use of hydraulic pistons as the means by which the separation between the base and the cover can be varied since they are not then required to withstand all of any forces tending to move the cover longitudinally of itself, although the pistons themselves effect the opening and closing of the linkage. In particular forms of this linkage, the upper part is in the form of a shield acting as a downwardly directed extension of the cover.

Now it is not possible always to ensure that the roof of a mine is parallel to the floor so it is desirable to incorporate in the support, means whereby such irregularities may be incorporated. In the particular example that has been referred to, the longitudinal pistons may expand to different extents, and the present invention may be used to establish a connection between the framework and the cover. The invention may, however, be used in other circumstances in which a connection is to be effected between the cover and a framework.

According to the present invention, there is provided a mine roof support having a base and a roof engaging cover, adjustment means mounted on the base by which the cover can be moved towards and away from the base, and a framework movable with the adjustment means and to which the cover is connected so that it can tilt in all directions relatively to the framework, the connection between the components that are the cover and the framework including means forming an axle fixed relatively to one of the components and about which the cover can tilt relatively to the framework both about the axis of the axle and longitudinally of the axle, means limiting the angle through which the cover can tilt longitudinally of the axle, and means by which the axis about which the cover can tilt longitudinally of the axis is restricted to an upright plane, the means including a rod fixed to one of the components and journalled in a follower that co-operates with guide means fixed to the other of the components, the co-operation between the guide means and the follower being such as to permit and confine movement of the axis of the rod in and to the upright plane.

By way of example, an embodiment of the invention will now be described with reference to the accompanying drawings in which FIG. 1 shows in side elevation, and somewhat schematically, a mine roof support;

Figure 1:
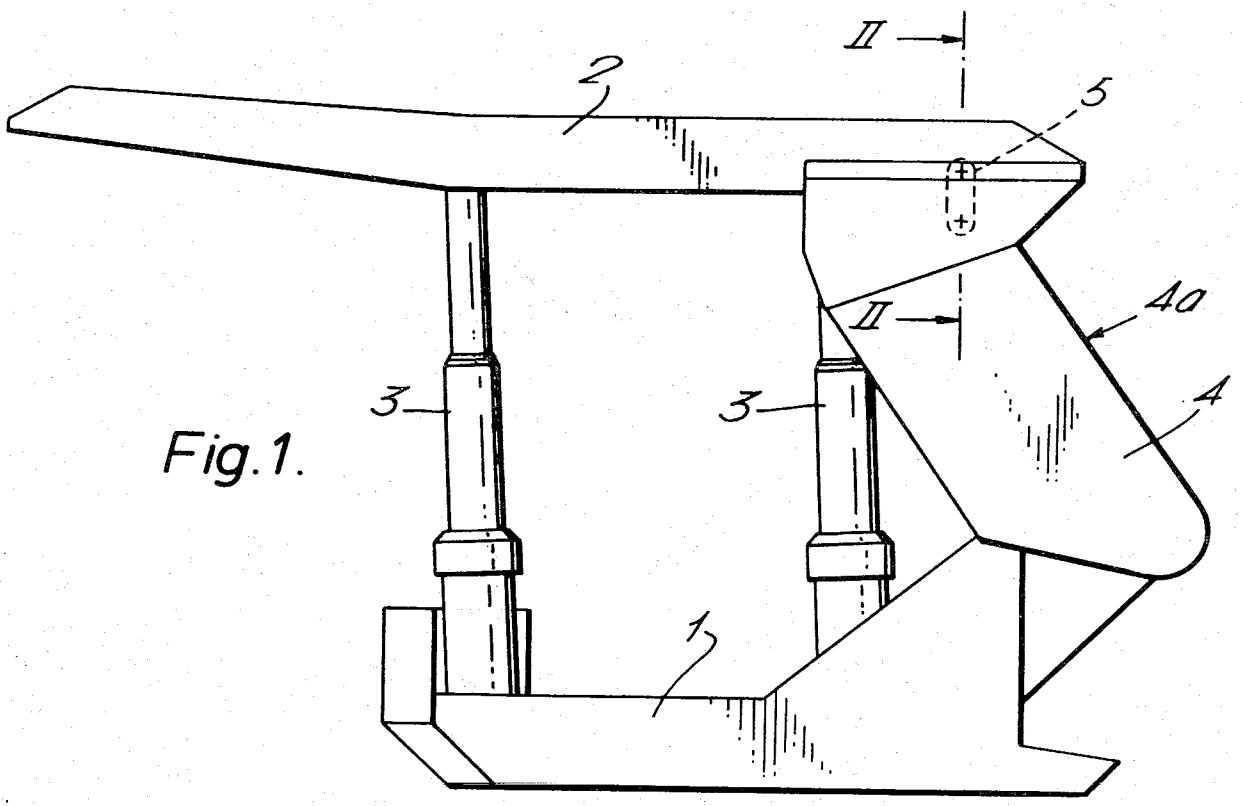
Figure 2:
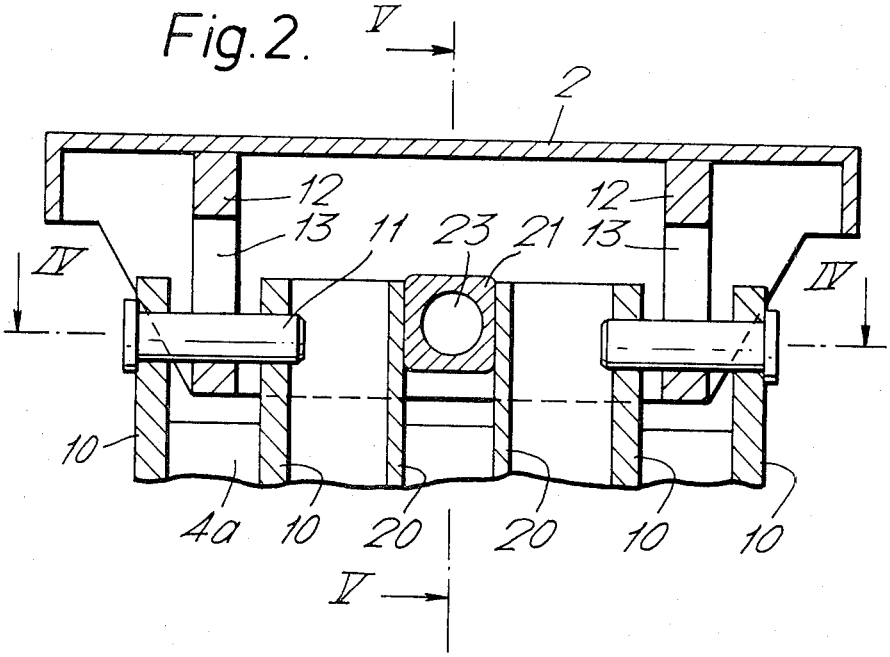
FIG. 2 shows a part section on the plane II—II of FIG. 1 with the cover paraliel to the base.

The mine roof support illustrated in FIG. 1 includes a base 1 and a cover, or canopy, 2 having downwardly extending flanges at its edges carried from the base 1 by four hydraulic rams 3. By operation of the rams 3, the separation between the base 1 and the cover 2 can be varied; with the cover 2 lowered, the support can move along the mine and by expanding the rams 3 the cover 2 can be forced into supporting engagement with the roof. The rams 3 can expand to different extents to hold the cover 2 against the roof even though the roof may not be exactly parallel to the floor on which the base 1 stands.

The rear end of the cover 2 is connected to the rear end of the base 1 by a framework 4 incorporating a "lemniscate" linkage of which the knuckle extends more to the rear of the base 1 as the cover 2 is lowered towards it. The connection between the cover 2 and the framework 4 is denoted generally by 5 and the effect of the "lemniscate" linkage, such devices being known, is to ensure that as the cover 2 rises and falls relatively to the base 1, the connection 5 moves in a plane that is generally perpendicular to the base 1. The upper part of the framework, moreover, includes a plate 4*a* extending from side to side of the support to act as a rearwardly projecting extension of the cover 2. Unlike the hydraulic rams 3, however, the framework is not adjustable to vary roof formations, and the connection 5, which will now be described in more detail provides the appropriate accommodation.

Figure 3:
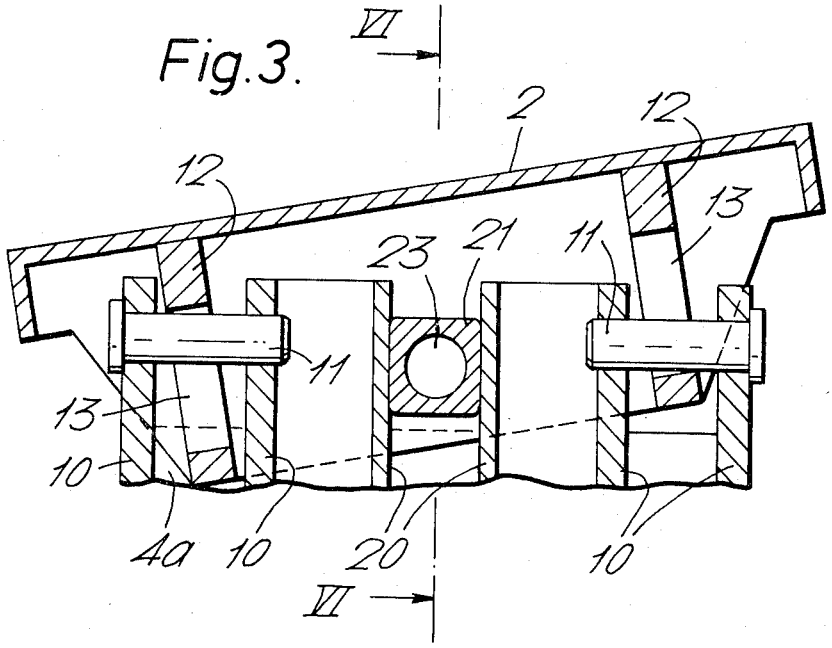
FIG. 3 shows a modification of FIG. 2 illustrating the cover tilted transversely relatively to the base.
Figure 4:
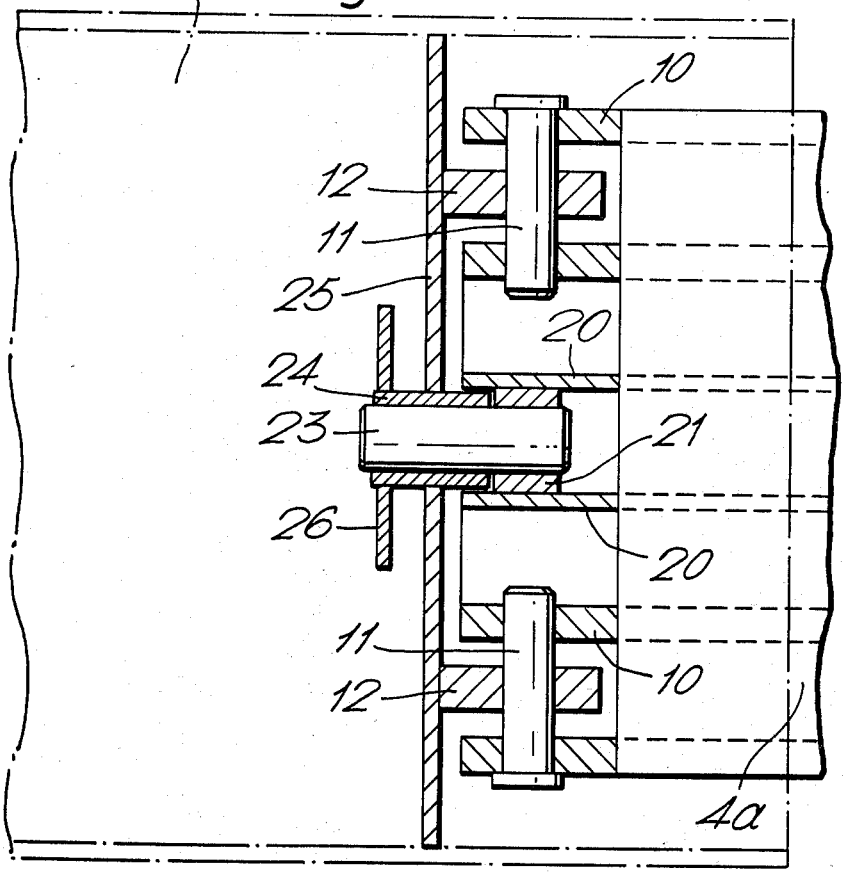
FIG. 4 shows a section through FIG. 2 on the plane IV—IV.
Figure 5:
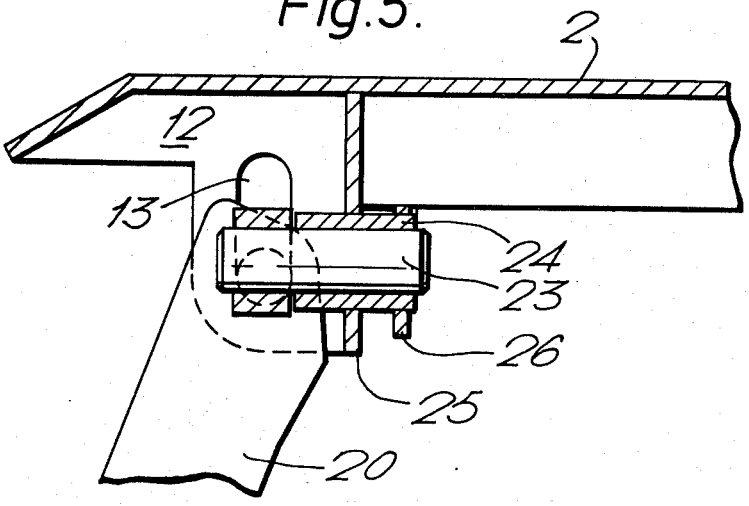
FIG. 5 shows a section through FIG. 2 on the plane V—V.
Figure 6:
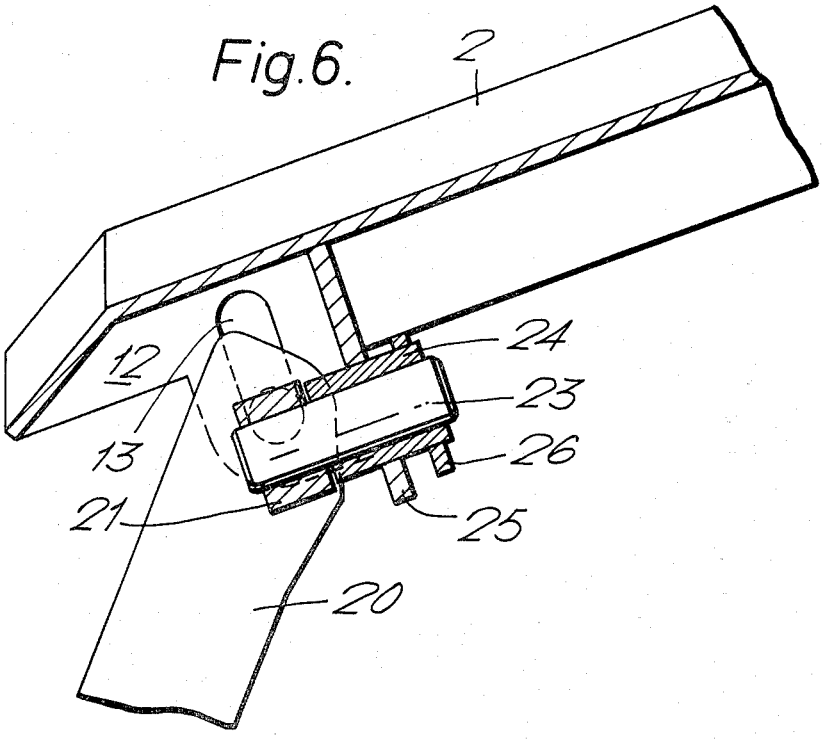
FIG. 6 shows a section through FIG. 3 on the plane VI—VI.
Figure 7:
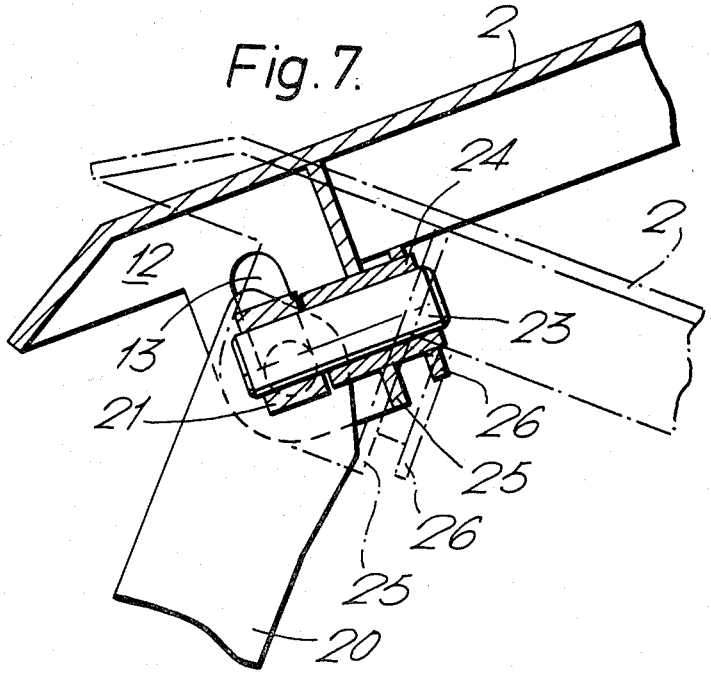
FIG. 7 is a section comparable to that of FIG. 4 but illustrates the cover tilted in the fore-and-aft direction of the base.

Integral with, projecting forwardly from, and symmetrically spaced about the centre line of the plate 4*a*, are two pairs of ribs or struts 10 and there is a stub 11 extending between each pair, the stubs 11 being axially aligned and together forming an axle about which the cover 1 can turn. Projecting downwardly from the cover 2 are two lugs 12 each having an elongated slot extending perpendicularly to the cover 2. Each stub 11 passes through one of the slots 13 and it will be seen that the arrangement permits the cover 2 to tilt relatively to the framework 4 both transversely of the support (as is illustrated by FIGS. 3 and 6) and in the fore-and-aft direction (as is illustrated by FIG. 7). The maximum permitted tilt transversely of the base is determined by the lengths of the slots 13; in the position of maximum tilt, the upper end of one slot 13 will abut its stub 11 and the lower end of the other slot 13 will abut its stub 11.

Means is also provided to ensure that the axis about which the cover 2 can tilt transversely is confined to a pre-determined vertical plane. This means will now be described.

Mid-way between, and parallel to, the pairs of struts 10, are two plates 20 that form guide means. A follower 21, in the form of a parallel sided block is slidable between the plates 20. The follower is penetrated by a bore parallel to the plate 20 and one end of a rod 23 is received within the bore with its axis lying in a plane perpeneicular to, and in the longitudinal direction, the cover. The rod 23 is fixed, at the end that does not lie within the base, within a bush 24, and the bush 24 is fixed to a reinforcing rib 25 extending across the cover and also supporting the lugs 12 and to a secondary brace 26. To permit the cover 2 to tilt laterally of the support, the rod 23 turns within the follower 21, and to permit the cover 2 to tilt in the fore-and-aft direction, the follower 21 slides between the guide-plate 20.

In the apparatus that has been described, the axis of the stubs 11 intersects the follower 21 but they could be more separated in the fore-and-aft direction with the result that the follower would move through a greater range as a result of tilting in the fore-and-aft direction of the cover.

It will also be realised that the connection that has been described could be used to connect the cover to a framework other than the particular framework that has been described.

I claim:

1. A mine roof support having a base and a roof engaging cover, adjustment means mounted on the base by which the cover can be moved towards and away from the base, and a framework movable with the adjustment means and to which the cover is connected so that it can tilt in all directions relatively to the framework, the connection between the components that are the cover and the framework including means forming an axle fixed relatively to one of the components and about which the cover can tilt relatively to the framework both about the axis of the axle and longitudinally of the axle, means limiting the angle through which the cover can tilt longitudinally of the axle, and means by which the axis about which the cover can tilt longitudinally of the axis is restricted to an upright plane, the means including a rod fixed to one of the components and journalled in a follower that co-operates with guide means fixed to the other of the components, the co-operation between the guide means and the follower being such to permit and confine movement of the axis of the rod in and to the upright plane.

2. A mine roof support as claimed in claim 1 in which the guide means is in the form of two spaced parallel plates and the follower is a parallel-sided block of which the sides slidingly engage the plates.

3. A mine roof support as claimed in claim 1 in which the rod is fixed relatively to the cover.

4. A mine roof support as claimed in claim 1 in which the axle is in two parts lying one on each side of the axis of the rod.

5. A mine roof support as claimed in claim 1 in which the component relatively to which the axle is not fixed is provided with two slots through which the axle passes, the slots lying one on each side of the guide and follower, and the ends of the slots, by abutment with the axle, serving to limit the angle through which the cover can tilt longitudinally of the axle.

6. A mine roof support as claimed in claim 1 in which the framework forms part of a linkage by which the cover is connected to the base, the linkage being such as to constrain the axis of the axle to move, during movement of the cover relatively to the base, in a plane that is generally perpendicular to the base.

7. A mine roof support as claimed in claim 1 in which the framework is in the form of a shield that during use of the support serves as a downwardly directed extension of the cover.

* * * * *